US010807099B2

(12) United States Patent
Tanaka et al.

(10) Patent No.: US 10,807,099 B2
(45) Date of Patent: Oct. 20, 2020

(54) DEVICE FOR PREPARING NANOFRAGMENTED PRODUCT AND METHOD FOR PREPARING NANOFRAGMENTED PRODUCT

(71) Applicant: CHUETSU PULP & PAPER CO., LTD, Takaoka-shi, Toyama (JP)

(72) Inventors: Hiroyuki Tanaka, Takaoka (JP); Hiromi Hashiba, Takaoka (JP)

(73) Assignee: CHUETSU PULP & PAPER CO., LTD, Toyama (JP)

( * ) Notice: Subject to any disclaimer, the term of this patent is extended or adjusted under 35 U.S.C. 154(b) by 661 days.

(21) Appl. No.: 15/107,161

(22) PCT Filed: Dec. 24, 2014

(86) PCT No.: PCT/JP2014/084039
§ 371 (c)(1),
(2) Date: Jun. 22, 2016

(87) PCT Pub. No.: WO2015/098909
PCT Pub. Date: Jul. 2, 2015

(65) Prior Publication Data

US 2016/0348315 A1 Dec. 1, 2016

(30) Foreign Application Priority Data

Dec. 25, 2013 (JP) ..... 2013-266685
Aug. 12, 2014 (JP) ..... 2014-164339

(51) Int. Cl.
*B02C 19/06* (2006.01)
*D21H 15/02* (2006.01)
*D21H 11/18* (2006.01)

(52) U.S. Cl.
CPC ..... *B02C 19/061* (2013.01); *B02C 19/06* (2013.01); *B02C 19/063* (2013.01);
(Continued)

(58) Field of Classification Search
CPC ... B02C 19/061; B02C 19/063; B02C 19/065; B02C 19/066; B02C 19/068;
(Continued)

(56) References Cited

U.S. PATENT DOCUMENTS 4,313,737 A * 2/1982 Massey ..... B03B 1/00 241/1
7,357,339 B2 * 4/2008 Kondo ..... C08J 3/12 241/1

(Continued)

FOREIGN PATENT DOCUMENTS

JP 10-337457 A 12/1998
JP 2005-270891 A 10/2005
JP 2012-36518 A 2/2012

OTHER PUBLICATIONS

Mobley, R.K.. Fluid Power Dynamics, Chapter 3: Hydraulic Pumps. 2000. Elsevier. p. 25-46 (attached). Retrieved from: https://app.knovel.com/hotlink/toc/id:kpFPD00001/fluid-power-dynamics/fluid-power-dynamics.*

(Continued)

*Primary Examiner* — Shelley M Self
*Assistant Examiner* — Katie L. Parr
(74) *Attorney, Agent, or Firm* — Sughrue Mion, PLLC

(57) ABSTRACT

A device and method for preparing a nano-fragmented product. A polysaccharide slurry is circulated in a polysaccharide supply path (3) via a chamber (2). Specifically, using a pump (8), the polysaccharide slurry in a tank (7) is circulated in a circulation path (9) which is formed using a vinyl hose, a rubber hose or the like. On the other hand, another slurry than the polysaccharide slurry is circulated through a second fluid medium supply path (4) as another circulation path via the chamber (2). Specifically, using a pump (11), the slurry other than the polysaccharide slurry in a tank (10) is caused to pass through a heat exchanger (12)

(Continued)

and a plunger (13) and thereby circulate in the other circulation path. The slurry other than the polysaccharide slurry circulated in the second fluid medium supply path (4) is orifice-injected against the polysaccharide slurry circulated in the polysaccharide slurry supply path (3) and flowing through the chamber (2).

6 Claims, 7 Drawing Sheets

(52) U.S. Cl.
CPC ..... *B02C 19/065* (2013.01); *B02C 19/066* (2013.01); *B02C 19/068* (2013.01); *D21H 11/18* (2013.01); *D21H 15/02* (2013.01)

(58) Field of Classification Search
CPC ..... B02C 19/06–068; C08J 3/12; C08J 3/122; D21H 11/18; D21H 15/02; B01F 5/0256; B01F 5/0262
USPC ..... 241/1, 5, 12, 15, 28, 38, 39, 40, 97, 21, 241/26
See application file for complete search history.

(56) References Cited

U.S. PATENT DOCUMENTS 8,398,007 B2 * 3/2013 Ito ..... B02C 19/061 241/39
9,022,307 B2 * 5/2015 Kakuda ..... B02C 19/0043 241/40
2005/0236121 A1 10/2005 Kondo et al.
2006/0032953 A1 * 2/2006 Kruse ..... B02C 19/065 241/40
2009/0314864 A1 * 12/2009 Kruse ..... B02C 19/065 241/39
2010/0166573 A1 * 7/2010 Magami ..... F04B 3/00 417/267
2010/0252660 A1 * 10/2010 Kozyuk ..... B02C 19/065 241/25
2012/0234603 A1 * 9/2012 Vail, III ..... E21B 4/02 175/57

OTHER PUBLICATIONS

International Search Report of PCT/JP2014/084039, dated Mar. 17, 2015. [PCT/ISA/210].

* cited by examiner

DEVICE FOR PREPARING NANOFRAGMENTED PRODUCT AND METHOD FOR PREPARING NANOFRAGMENTED PRODUCT

CROSS-REFERENCE TO RELATED APPLICATIONS

This application is a National Stage of International Application No. PCT/JP2014/084039 filed Dec. 24, 2014, claiming priority based on Japanese Patent Application No. 2013-266685 filed Dec. 25, 2013 and Japanese Patent Application No. 2014-164339 filed Aug. 12, 2014, the contents of all of which are incorporated herein by reference in their entirety.

TECHNICAL FIELD

The present invention relates to a device for preparing a nanofragmented product and a method for preparing a nanofragmented product.

BACKGROUND ART

It is known that cellulose is produced as a fibrous form in nature by plants, for example, woody plants such as hardwoods and softwoods, and herbaceous plants such as bamboo and reed, some animals typified by sea squirt, and some fungi typified by acetobacter, and the like. Cellulose molecules having a structure of aggregate in a fibrous form are called a cellulose fiber. In particular, a cellulose fiber having a fiber width of 100 nm or less and an aspect ratio of 100 or more is generally called a cellulose nanofiber (hereinafter referred to as CNF) and has excellent properties such as light weight, high mechanical strength and low coefficient of thermal expansion.

In nature, a CNF does not exist in the form of a single fiber except those produced by some fungi typified by acetobacter. Most of CNFs exist in a firmly aggregated form by interaction typified by hydrogen bonding between CNFs, which form has a micro-size fiber width. Fibers having such a micro-size fiber width exist in a further highly aggregated form.

In a papermaking process, wood is fibrillated by a pulping method typified by a kraft cooking method as one of chemical pulping methods to a state of pulp having a micro-size fiber width, and paper is prepared using the pulp as a starting material. The fiber width of pulp varies depending upon a starting material and is about 5-20 μm, about 20-80 μm and about 5-20 μm with respect to bleached hardwood kraft pulp, bleached softwood kraft pulp and bleached bamboo kraft, respectively.

As described above, such pulp having a micro-size fiber width is an aggregate of single fibers which has a fibrous form and in which CNFs are firmly aggregated by interaction typified by hydrogen bonding, and CNFs as single fibers having a nano-size fiber width are obtained by further advancing fibrillation.

As a mechanical method for preparing a CNF, a homogenizing treatment method is described in Patent Document 1, in which a dispersion comprising starting material fibers dispersed in a solvent is treated by means of a homogenizer equipped with a crushing type homovalve sheet. According to the homogenizing treatment method, as shown in FIG. 6, starting material fibers pressure-fed in such a homogenizer under high pressure are forced to pass through a small diameter orifice 102 in the form of a narrow aperture and to collide against a wall surface of the small diameter orifice 102 (in particular, a wall surface of an impact ring 103) and are thereby cleaved under shearing stress or cleaving action. Thus, micro-fibrillation is effected to obtain micro-fibrils having substantially uniform fiber diameters. This is believed to be as follows. In particular, on passing through an aperture defined by the homovalve sheet 105 and a homovalve 106, the dispersion which has passed through a flow path 104 in the homovalve sheet undergoes sudden increase in its flow velocity. Thereupon, intensive cavitation occurs in the dispersion which has passed through the aperture to cause increase in colliding force against the wall surface in the small diameter orifice 102 and collapse of air bubbles, thereby realizing uniform micro-fibrillation of the starting material fibers.

An aqueous counter collision method as another mechanical method for preparing a CNF is such a technique, as disclosed in Patent Document 2, that natural cellulose fibers suspended in water are introduced into opposing two nozzles (FIG. 7: 108) in a chamber (FIG. 7: 107) and jetted from these nozzles toward one point and thereby caused to collide (see FIG. 7). With this method, jets of an aqueous suspension of natural microcrystalline cellulose fibers (for example, Funacell manufactured by Funakoshi Co., Japan) are counter-collided to nano-fibrillate and thereby strip off surfaces of the fibers. This improves affinity of the fibers for water as a carrier and thereby enables the nano-fibrillated fibers to be finally brought to a nearly dissolved state. The device shown in FIG. 7 is of a liquid circulation type and comprises a tank (FIG. 7: 109), a plunger (FIG. 7: 110), opposing two nozzles (FIG. 7: 108*a*, 108*b*) and, if desired, a heat exchanger (FIG. 7: 115). In the device, fine particles dispersed in water are introduced into the opposing two nozzles (FIG. 7: 108*a*, 108*b*) and jetted from the opposing nozzles (FIG. 7: 108*a*, 108*b*) under high pressure to cause the fine particles to counter collide in water. In this method, only water is used other than natural cellulose fibers, and nano-fibrillation is effected by cleaving only interaction between the fibers, and hence no substantial structural change of cellulose molecules is caused. Accordingly, it is possible to obtain a nano-fibrillated product with lowering of polymerization degree of cellulose associated with the cleavage minimized.

PRIOR ART DOCUMENTS

Patent Documents

Patent Document 1: Japanese Unexamined Patent Publication No. 2012-36518

Patent Document 2: Japanese Unexamined Patent Publication No. 2005-270891

SUMMARY OF THE INVENTION

Problem to be Solved by the Invention

The homogenizing treatment method disclosed in Patent Document 1 has such a problem that the area of the small diameter orifice 102 between the homovalve sheet 105 and the homovalve 106 is likely to be clogged with pulp fibers, and the homovalve 106 is thus pushed or drawn by automatic control to regulate pressure, and accordingly, quality of the resulting product is unstable. In other words, some of the fibers are released under very high pressure and the other of the fibers are released under relatively low pressure to cause variation in quality of the resulting products.

The aqueous counter collision method disclosed in Patent Document 2 has such a problem that pulp which is not nanofibrillated passes through each of the sections of the device such as the plunger and thus obstruction with the pulp material is likely to occur, leading to trouble. Further, the aqueous counter collision method, in which the dispersion of the pulp is jetted from the two opposing nozzles, has such a problem that even if one of the nozzles becomes obstructed, sign indicating process abnormality does not appear immediately, and the abnormality is not noticed for a while, leading to deterioration of quality of the resulting product. Additionally, in the aqueous counter collision method, since the dispersion of the pulp is jetted from the two nozzles, the nozzle diameter is required to be reduced in order to obtain high pressure, and consequently, obstruction with the material is likely to occur. As measures to cope with this, pretreatment to roughly pulverize pulp in advance is required. However, the pulp is mechanically damaged by the pretreatment to cause lowering of polymerization degree of the pulp.

In view of the above problems in the conventional techniques, it is an object of the present invention to provide a device for preparing a nano-fragmented product and a method for preparing a nano-fragmented product, which exhibit high productivities and are capable of obtaining a nano-fragmented product with polymerization degree lowering associated with cleavage minimized.

Means to Solve the Problem

Accordingly, the device for preparing a nano-fragmented product of the present invention is characterized in that the device comprises:

a first fluid medium supply path; and a second fluid medium supply path disposed in a direction intersecting the first fluid medium supply path;

the first fluid medium supply path being provided with a polysaccharide slurry supply section for supplying a polysaccharide slurry to the first medium supply path;

the second fluid medium supply path being provided therein with an orifice-injection part for orifice-injecting water or fragmented polysaccharide slurry;

wherein a jet orifice-injected from the orifice-injection part passes across the first fluid medium supply path.

Effect of the Invention

According to the device for preparing a nano-fragmented product and the method for preparing the nano-fragmented product of the present invention, it is possible to obtain a nano-fragmented product derived from a polysaccharide with lowering in polymerization degree associated with cleavage minimized in a highly productive manner.

MODE FOR CARRYING OUT THE INVENTION

In the following, an embodiment of the device for preparing a nano-fragmented product according to the present invention will be described.

Figure 1:
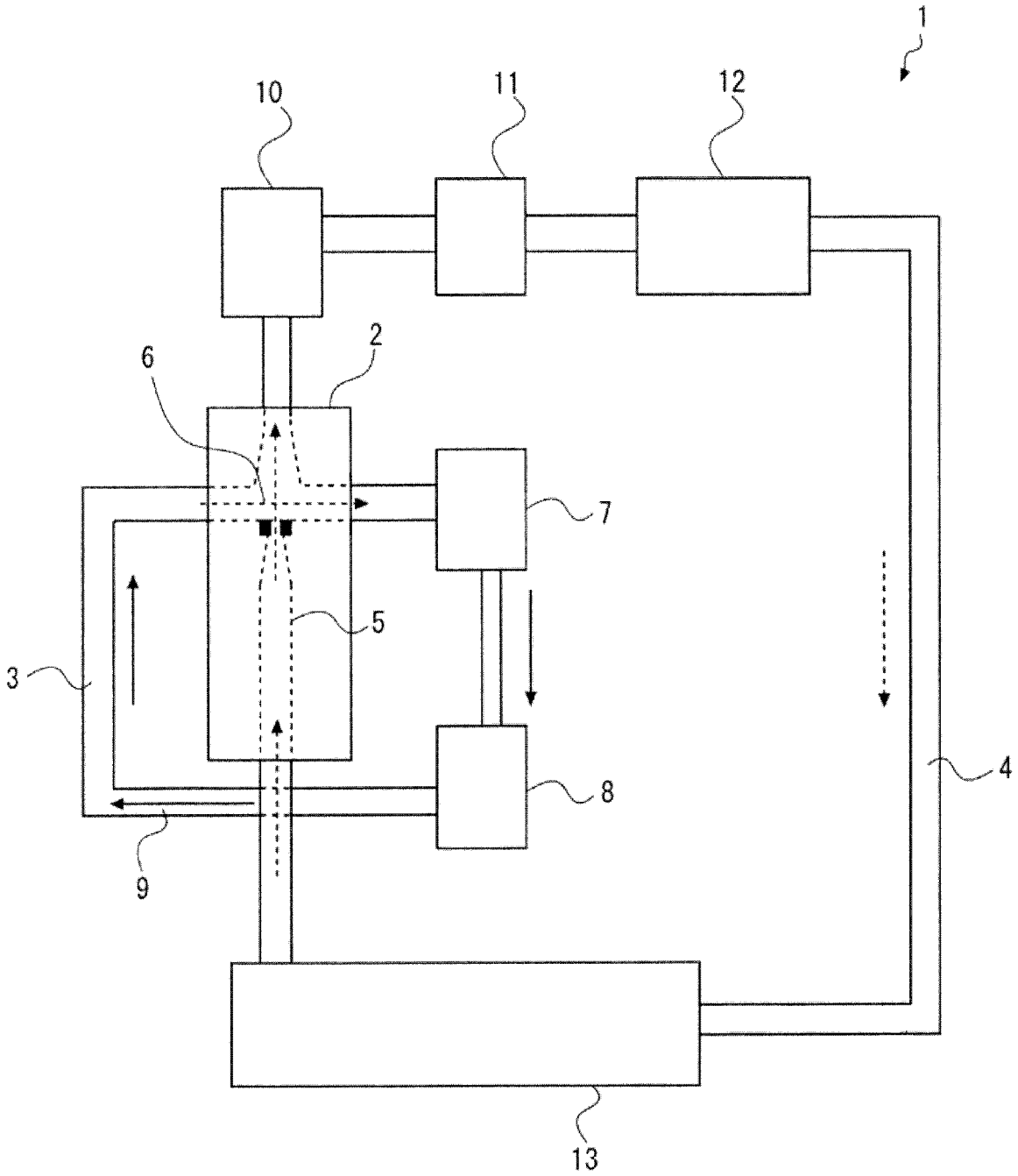
FIG. 1 is a conceptual view of an embodiment of a device for preparing a nano-fragmented product according to the present invention.

As shown in FIG. 1, a device for preparing a nano-fragmented product 1 of this embodiment comprises a single chamber 2, a polysaccharide slurry supply path 3 as a first fluid medium supply path which is so disposed as to be capable of supplying a polysaccharide slurry to the single chamber 2, and a second fluid medium supply path 4 which permits water or fragmented polysaccharide slurry to circulate therein via the single chamber 2. In the single chamber 2, an orifice injection part 5 is provided for orifice-injecting the water or fragmented polysaccharide slurry in the second fluid medium supply path 4 in a direction intersecting the direction of polysaccharide supply from the polysaccharide slurry supply path 3.

In this embodiment, the polysaccharide supply path 3 permits the polysaccharide slurry to be circulated via chamber 2 as shown in FIG. 1.

In this embodiment, the polysaccharide slurry supply path 3 and the second fluid medium supply path 4 have a mutual intersection 6 in the single chamber 2.

The polysaccharide slurry supply path 3 is provided with as a polysaccharide supply section and comprises a tank 7 for impounding the polysaccharide slurry and a pump 8 which are disposed in a circulation path 9 as one form of the polysaccharide slurry supply path 3. On the other hand, the second fluid medium supply path 4 functions as a circulation path and comprises a tank 10, a pump 11, a heat exchanger 12, and a plunger 13, which are disposed therein.

The expression or term "water or fragmented polysaccharide slurry" used in the present invention comprehensively means water or a fragmented polysaccharide slurry containing nano-fragmented polysaccharide in a concentration which increases according to the degree of progress of the operation in such a manner that the water or fragmented polysaccharide slurry is initially just water and is caused to pass through the mutual intersection 6 and return into the tank 10 repeatedly, as the device for preparing a nono-fragmented product according to the present invention operates, and consequently, develops into a nano-fragmented polysaccharide slurry containing nano-fragmented polysaccharide in such a concentration. The term is intended to clarify the distinction of the water or fragmented polysaccharide slurry from the polysaccharide slurry introduced into the tank 7 and circulated through the circulation path 9. The term is by no means intended to mean that "the water or fragmented polysaccharide slurry" contains no fibrous polysaccharide or fragmented fibrous polysaccharide.

Figure 2:
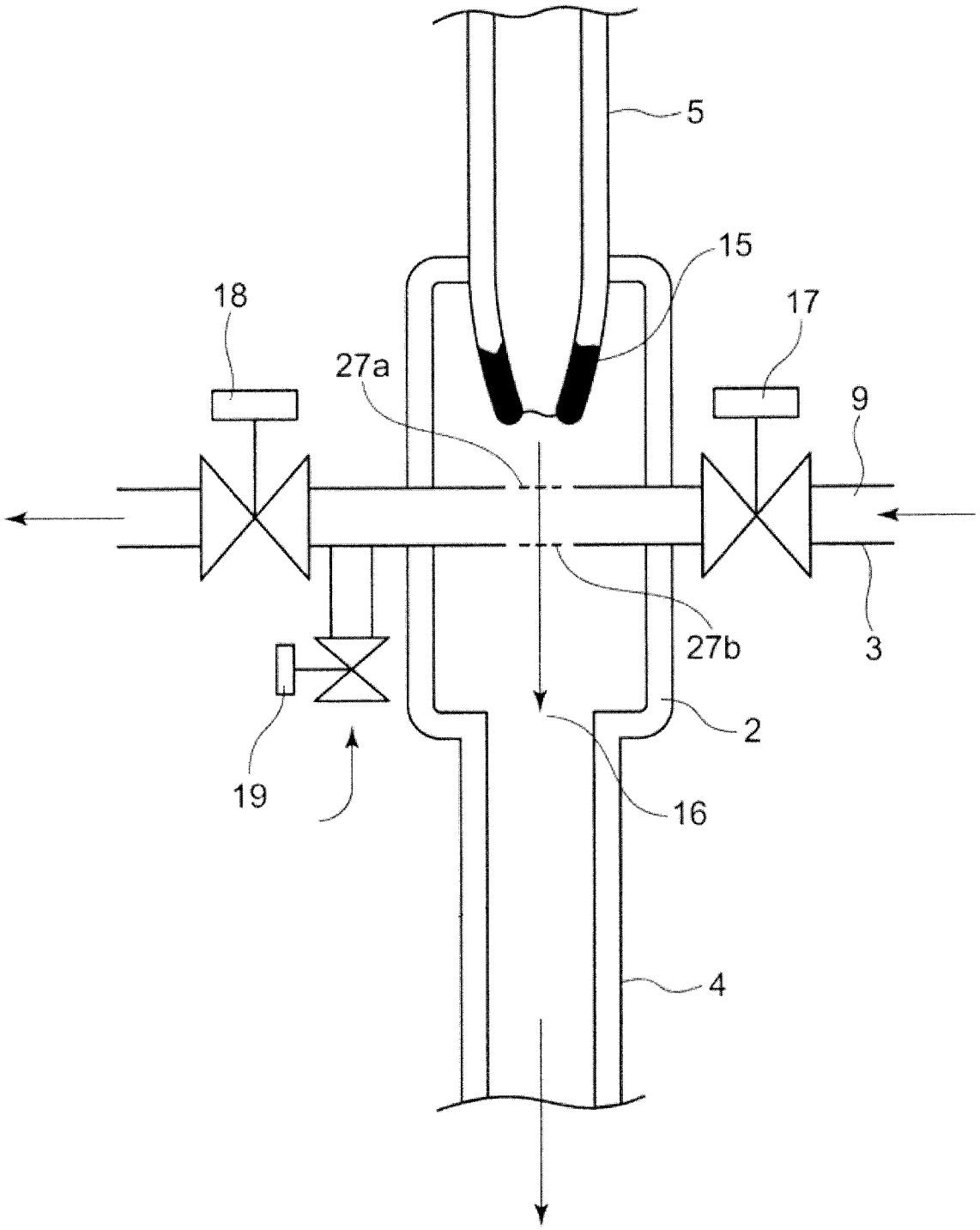
FIG. 2 is a conceptual view showing a part of the device for preparing a nano-fragmented product of the embodiment shown in FIG. 1 in an enlarged scale.

As shown in FIG. 2, the circulation path 9 as one form of the polysaccharide supply path 3 is so disposed as to pass through the camber 2, and an orifice injection opening 15 of an orifice injection part 5 connected to the plunger 13 in the second fluid medium supply path 4 is set to open in the chamber 2 so as to permit the water or fragmented polysaccharide slurry to pass across the circulation path 9 in a direction intersecting the circulation path 9. An outlet 16 of the chamber 2 is provided at the position opposite to the orifice opening 15 in the chamber 2, and the circulation path of the second fluid medium supply path 4 is connected to the outlet 16 of the chamber 2 to constitute the second fluid medium supply path 4.

When the water or fragmented polysaccharide slurry is caused to pass across the circulation path 9 by the orifice-injection at an angle of 5°-90° in a direction not against the flow of the polysaccharide slurry through the circulation path 9, i.e., in a direction along the flow of the polysaccharide slurry, the polysaccharide slurry flowing through the circulation path 9 is thereby efficiently entrained in the orifice-injected water or fragmented polysaccharide slurry. When the angle is 15°-85°, the efficiency of the entrainment is further increased.

On the other hand, when the water or fragmented polysaccharide slurry is caused to pass across the circulation path 9 by the orifice-injection at an angle of 5° or more and smaller than 90° in a direction against the flow of the polysaccharide slurry through the circulation path 9, energy of collision of the orifice-injected water or fragmented polysaccharide slurry against the polysaccharide slurry is efficiently utilized for the fragmentation of the polysaccharide. When the angle is 15°-85°, the efficiency of the fragmentation is further increased.

On the other hand, the circulation path 9 as one form of the polysaccharide supply path 3 is formed using, for example, a vinyl hose, a rubber hose or the like. On the entry side of the circulation path 9 to the chamber 2, a one-way valve 17 is provided which opens only in the direction toward the chamber 2. On the exit side of the circulation path 9 from the chamber 2, a one-way valve 18 is provided which opens only in the discharge direction from the chamber 2. In addition, between the chamber 2 and the one-way valve 18, the circulation path 9 is provided with an air intake valve 19. The air intake valve 19 opens only in the direction of air intake from the outside of the circulation path 9.

Figure 3:
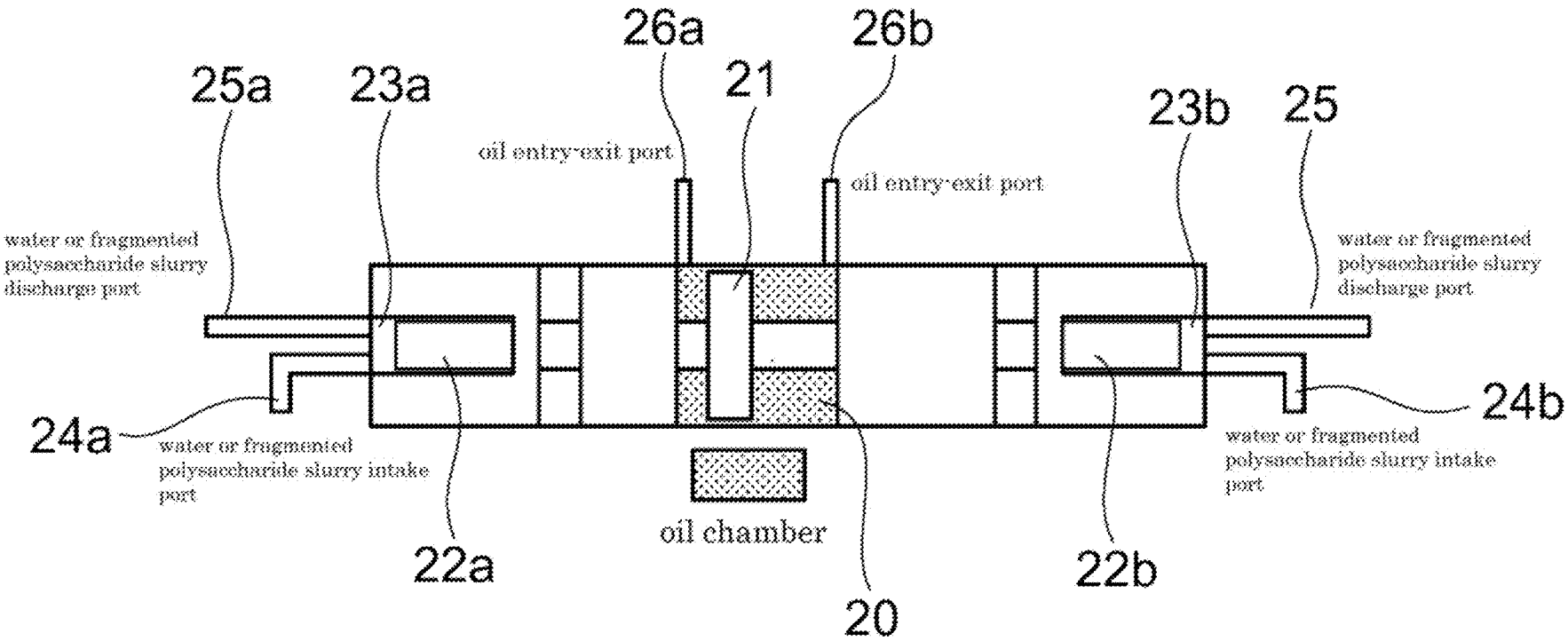
FIG. 3 is another conceptual view showing another part of the device for preparing a nano-fragmented product of the embodiment shown in FIG. 1 in an enlarged scale.

As shown in FIG. 3, the plunger 13 comprises an oil chamber 20 located at the middle thereof, a hydraulically-actuated member 21 slidably disposed in the oil chamber 20 and pistons 22*a*, 22*b* for intake-discharge of the water or fragmented polysaccharide slurry located on either side of the hydraulically-actuated member 21. The pistons 22*a*, 22*b* for intake-discharge slide in chambers 23*a*, 23*b* for intake-discharge of the water or fragmented polysaccharide slurry, respectively. The chambers 23*a*, 23*b* for intake-discharge of the water or fragmented polysaccharide slurry comprises water or fragmented polysaccharide slurry intake ports 24*a*, 24*b* each provided with a one-way valve (not shown), and water or fragmented polysaccharide slurry discharge ports 25*a*, 25*b*, respectively. Further, the oil chamber 20 is provided with a pair of oil entry-exit ports 26*a*, 26*b* oppositely located with the hydraulically-actuated member 21 between them.

With the plunger 13 of the above-described structure, when hydraulic pressure is applied to the inside of the oil chamber 20 through the oil entry-exit port 26*a*, the hydraulically-actuated member 21 is actuated and the water or fragmented polysaccharide slurry is consequently sucked into the chamber 23*a* for intake-discharge of the water or fragmented polysaccharide slurry through the water or fragmented polysaccharide slurry intake port 24*a*. In parallel therewith, the water or fragmented polysaccharide slurry in the chamber 23*b* for intake-discharge of the water or fragmented polysaccharide slurry is discharged from the water or fragmented polysaccharide slurry discharge port 25*b*. When hydraulic pressure is applied to the inside of the oil chamber 20 through the oil entry-exit port 26*b*, the hydraulically-actuated member 21 is actuated and the water or fragmented polysaccharide slurry is consequently sucked into the chamber 23*b* for intake-discharge of the water or fragmented polysaccharide slurry through the water or fragmented polysaccharide slurry intake port 24*b*. In parallel therewith, the water or fragmented polysaccharide slurry in the chamber 23*a* for intake-discharge of the water or fragmented polysaccharide slurry is discharged from the water or fragmented polysaccharide slurry discharge port 25*a*.

In consequence of the action of the plunger 13 as described above, according to the device for preparing a nano-fragmented product of this embodiment, the intake of the water or fragmented polysaccharide slurry into the plunger 13 and the discharge of the water or fragmented polysaccharide slurry from the plunger 13 are effected in parallel to supply the water or fragmented polysaccharide slurry from the plunger 13 to the orifice injection opening 15 of the orifice injection part 5 connected to the plunger 13 in a continuous and pulse-repressive manner.

According to the device for preparing a nano-fragmented product of the above-described embodiment, a nano-fragmented product is prepared as follows.

The water or fragmented polysaccharide slurry is circulated through the second fluid medium supply path 4 via the chamber 2. Specifically, using the pump 11, the water or fragmented polysaccharide slurry in the tank 10 is caused to pass through the heat exchanger 12 and the plunger 13 and thereby circulated in the second fluid medium supply path 4. On the other hand, the polysaccharide slurry is circulated in the polysaccharide supply path 3 via the chamber 2. Specifically, using the pump 8, the polysaccharide slurry in the tank 7 is circulated in the circulation path 9 which is formed using a vinyl hose, a rubber hose or the like.

On the basis of this, the water or fragmented polysaccharide slurry circulated in the second fluid medium supply path 4 is orifice-injected against the polysaccharide slurry circulated in the polysaccharide slurry supply path 3 through the chamber 2. Specifically, high pressure water is supplied from the plunger 13 to the orifice injection opening 15 connected to the plunger 13, and the high pressure water is orifice-jetted from the orifice injection opening 15 toward the circulation path 9.

In consequence, the highly pressurized water or fragmented polysaccharide slurry passes across, in a direction intersecting the circulation path 9, the inside of the circulation path 9 via a through-hole defined by holes 26*a*, 26*b* preliminarily provided in the circulation path 9 which is formed using, for example, a vinyl hose, a rubber hose or the like, while entraining the polysaccharide slurry circulating in the circulation path 9. The water or fragmented polysaccharide slurry which has passed across the circulation path 9 rushes toward the outlet 16 of the chamber 2 and enters the second fluid medium supply path 4. The water or fragmented polysaccharide slurry is thereby re-circulated in the second fluid medium supply path 4.

In the above-described process, since plunger 13 is so constructed as to be capable of effecting intake and discharge of the water or fragmented polysaccharide slurry in parallel, orifice-injection from the orifice injection opening 15 toward the circulation path 9 is performed in a ceaseless and substantially pulse-free manner, i.e., continuous manner as compared with a case where a plunger 13 alternately performs intake and discharge of a water or fragmented polysaccharide slurry.

Further, the preparation of a nano-fragmented product by the device for preparing a nano-fragmented product of the above embodiment may be carried out employing the following modes in combination.

(A) The one-way valve 17 and the one-way valve 18 are open, and the air intake valve 19 is closed.

In this case, the water or fragmented polysaccharide slurry circulated in the second fluid medium supply path 4 is continuously orifice-injected, with the polysaccharide slurry being continuously circulated in the polysaccharide slurry supply path 3 via the chamber 2. By preliminarily knowing flow velocity of the water or fragmented polysaccharide slurry circulated in the second fluid medium supply path 4, number of the circulation can be determined in relation to operation time.

(B) The one-way valve 17 is open, and the one-way valve 18 and the air intake valve 19 is closed.

In this case, with the polysaccharide slurry permitted to flow into the chamber 2 but not circulated in the polysaccharide slurry supply path 3, the water or fragmented polysaccharide slurry circulated through the second fluid medium supply path 4 is orifice-injected. Consequently, the water or fragmented polysaccharide slurry rushes toward the outlet 16 of the chamber 2, while continuously entraining the polysaccharide slurry in the circulation path 9, and enters the second fluid medium supply path 4. The polysaccharide slurry is steadily replenished from the tank 7 for the decrement of the polysaccharide slurry due to the effluence by the entrainment.

(C) The one-way valve 18 is open, and the one-way valve 17 and the air intake valve 19 are closed.

In this case, with the polysaccharide slurry not permitted to flow into the chamber 2 and not circulated in the polysaccharide supply path 3, the water or fragmented polysaccharide slurry circulated through the second fluid medium supply path 4 is continuously orifice-injected. In consequence, the water or fragmented polysaccharide slurry rushes toward the outlet 16 of the chamber 2 without entraining the polysaccharide slurry in the circulation path 9 and enters the second fluid medium supply path 4.

Accordingly, by conducting one pass (one circulation) or more of the operation in the above described mode (A) and then changing the operation mode to the mode (C), the fragmented fibrous polysaccharide, which has been entrained in the water or fragmented polysaccharide slurry circulated through the second fluid medium supply path 4 from the polysaccharide slurry continuously circulated in the polysaccharide slurry supply path 3 by the operation in the mode (A), is circulated in the second fluid medium supply path 4 and continuously orifice-injected from the orifice-injection opening 15 toward the circulation path 9. The fragmented fibrous polysaccharide is gradually further fragmented by the energy of the orifice injection. Since only interaction between fibers is cleaved with the aid only of water, it is thereby possible to realize the operation for obtaining a nano-fragmented product with lowering of the polymerization degree associated with the cleavage minimized.

(D) The one-way valve 17, the one-way valve 18 and the air intake valve 19 are closed.

In this case, with the polysaccharide slurry not permitted to flow into the chamber 2 and not circulated in the polysaccharide supply path 3, the water or fragmented polysaccharide slurry circulated through the second fluid medium supply path 4 is continuously orifice-injected. In consequence, the water or fragmented polysaccharide slurry rushes toward the outlet 16 the chamber 2 without entraining the polysaccharide slurry in the circulation path 9 and enters the second fluid medium supply path 4.

Accordingly, as in the case of the mode (C), by conducting one pass or more of the operation in the above described mode (A) and then changing the operation mode to the mode (D), the fragmented fibrous polysaccharide, which has been entrained in the water or fragmented polysaccharide slurry circulated through the second fluid medium supply path 4 from the polysaccharide slurry continuously circulated in the polysaccharide slurry supply path 3 by the operation in the mode (A), is circulated in the second fluid medium supply path 4 and continuously orifice-injected from the orifice-injection opening 15 toward the circulation path 9. The fragmented fibrous polysaccharide is gradually further fragmented by the energy of the orifice injection. Since only interaction between fibers is cleaved with the aid only of water, it is thereby possible to realize the operation for obtaining a nano-fragmented product with lowering of the polymerization degree associated with the cleavage minimized.

(E) The one-way valve 17 and the one-way valve 18 are closed, and the air intake valve 19 is open.

In this case, with the polysaccharide slurry not permitted to flow into the chamber 2 and not circulated in the polysaccharide supply path 3, the water or fragmented polysaccharide slurry circulated through the second fluid medium supply path 4 is continuously orifice-injected. In consequence, the water or fragmented polysaccharide slurry rushes toward the outlet 16 the chamber 2 without entraining the polysaccharide slurry in the circulation path 9 and enters the second fluid medium supply path 4. In the process, in a portion of the circulation path 9 formed using a vinyl hose, a rubber hose or the like between the one-way valve 17 and the one-way valve 18, negative pressure is generated by the continuously performed orifice-injection from the orifice-injection opening 15 toward the circulation path 9. By the negative pressure, external air is sucked in from the air intake valve 19. The external air is thus incorporated into the water or fragmented polysaccharide slurry circulated through the second fluid medium supply path 4.

Accordingly, by conducting one pass or more of the operation in the above described mode (A) and then changing the operation mode to the mode (E), the fragmented fibrous polysaccharide, which has been entrained in the water or fragmented polysaccharide slurry circulated through the second fluid medium supply path 4 from the polysaccharide slurry continuously circulated in the polysaccharide slurry supply path 3 by the operation in the mode (A), is circulated in the second fluid medium supply path 4 and continuously orifice-injected from the orifice-injection opening 15 toward the circulation path 9. The fragmented fibrous polysaccharide is gradually further fragmented by the energy of the orifice injection. In the process, according to the operation in the mode (E), since only interaction between fibers is cleaved with the aid only of water and collapse of bubbles incorporated in the water, it thereby is possible to realize the operation for obtaining a nano-fragmented product with lowering of the polymerization degree associated with the cleavage minimized.

According to the device for preparing a nono-fragmented product of this embodiment, since it is not necessary to pass the fibrous polysaccharide starting material anterior to the nano-fragmentation, i.e., the polysaccharide slurry in the tank 7 through the plunger 13, problem of clogging with the starting material is resolved. Further, since only one orifice-injection opening 15 of the orifice-injection part 5 is provided which constitutes a nozzle system for injecting the highly pressurized water, the nozzle system may be so designed as to have a large size. Accordingly, even if the fragmented fibrous polysaccharide slurry containing fibrous polysaccharide starting material which has happened to be contained therein for some cause is circulated through the second fluid medium supply path 4 comprising the plunger 13, clogging in the nozzle system is less likely to occur.

In addition, in the usual operation, what are caused to pass through the nozzle system are water and nano-fragmented cellulose, and no fibrous polysaccharide starting material happens to be contained therein. Accordingly, problem of clogging in the nozzle can be resolved.

Further, a nozzle diameter, i.e., a diameter of the orifice-injection opening 15 is required to be 0.6 mm or smaller in conventional methods, whereas, in the device for preparing a nano-fragmented product of this embodiment, high pressure state can be obtained even with a nozzle diameter, i.e., a diameter of the orifice-injection opening 15 of 0.8 mm.

In the above embodiment, the circulation path 9 is described as being formed using a vinyl hose, a rubber hose or the like. However, the circulation path 9 may be made of a stainless steel, and there is no particular restriction as to the material of the circulation path 9.

EXAMPLES

In the following, the present invention will be further specifically described with reference to Examples.

In the following manner, the method for preparing a nano-fragmented product of the present invention was carried out using the device for preparing a nano-fragmented product of the present invention to prepare a nano-fragmented product.

Water was filled in the tank 10, and the water is supplied to the plunger 13 via heat exchanger 12 using the pump 11. The plunger 13 was pressurized with a pressure of 50 MPa-400 MPa, and the pressurized water was fed to the orifice-injection opening 15 of the orifice-injection part 5 of the chamber 2 located in the water or fragmented polysaccharide slurry supply path 4.

On the other hand, a 1%-10% polysaccharide slurry was filled in the tank 7. Using the pump 8, the polysaccharide slurry in the tank 7 was circulated through the polysaccharide supply path 3 via chamber 2.

By providing the two circulation paths as described above, the highly pressurized water collided against the polysaccharide slurry in the chamber 2, and the fibrous polysaccharide in the polysaccharide slurry was nano-fragmented by the collision pressure and the cavitation force and delivered to the tank 7.

Thereafter, concentration of the fragmented fibrous polysaccharide in the tank 7 gradually increased, and a cellulose nanofiber product having an intended concentration was obtained.

Example 1

First, for circulation of a highly pressurized water or fragmented polysaccharide slurry, a through hole defined by holes 26*a*, 26*b* was formed in a rubber hose 9. Then, a polysaccharide slurry flowing through the circulation path 9 made of a rubber hose was once subjected to collisional treatment with the highly pressurized water to effect nano-fragmentation. The fibrous polysaccharide employed was bleached hardwood kraft pulp (LBKP), and a 3% slurry thereof was prepared and circulated. The highly pressurized water was injected under a pressure of 200 MPa. The thus obtained nano-fragmented polysaccharide slurry had a concentration of 1.09%. 200 cc of the nano-fragmented polysaccharide slurry resulting from the one-time collisional treatment was filtered on a Buchner funnel. The time taken for the filtration was 80 seconds in the untreated pulp slurry, whereas that in the nano-fragmented pulp slurry was 25 minutes. From the longer draining time, it was confirmed that the pulp was nano-fragmented by the one-time collisional treatment.

TABLE 1

| | untreated | Example 1 |
|---|---|---|
| concentration (%) | — | 1.086 |
| 0.1% freeness | 196 (1' 20") | 196 (25') |

Then, the sample obtained in Example 1 was diluted to prepare slurries. Theses slurries were compared with polysaccharide slurries which have not been subjected to fragmentation treatment in opacity. By comparing these slurries, it was confirmed that degree of swelling is higher in the nano-fragmented pulp sample obtained in Example 1.

Images of a sheet obtained by drying the slurry prepared in Example 1, which was observed with an electron microscope. It is seen from the electron microscopic observation at a magnification of 50 times that fragmented pulp spreads in a film-like form. Several fibers are observable at this magnification, and all of these fibers have been fragmented to 0.5 mm or less at longest.

In the electron micrograph taken at a magnification of 2,000 times, a number of nano-fragmented further fine fibers having a thickness of 1 μm or less were observable.

Example 2

In substantially the same manner as in Example 1, highly pressurized water was injected from the orifice-injection opening 15 of the orifice-injection part 5 of the second fluid medium supply path 4 against a slurry of bleached hardwood kraft pulp (LBKP) flowing though the polysaccharide slurry supply path 3. The highly pressurized water was allowed to pass across the slurry of bleached hardwood kraft pulp (LBKP) and then collected. The injection of the highly pressurized water was performed under pressure of 200 MPa. With respect to the nano-fragmented pulp slurry obtained by the collection, there were measured concentration, freeness, transmittance (%), polymerization degree, and height of sediment. The freeness was evaluated as an amount of water allowed to drain in a filtration of 200 cc of 0.1% aqueous cellulose nanofiber (CeNF) slurry. The transmittance (%) was evaluated as a transmittance of a 0.1% CeNF slurry and determined with respect to wavelengths of 400 nm and 600 nm. Besides, concentration, freeness, transmittance (%), and polymerization degree were measured also with respect to a slurry of bleached hardwood kraft pulp (LBKP) as Comparative Example 1, which slurry had not yet been subjected to such a collisional treatment that highly pressurized water was injected from the orifice-injection opening 15 of the orifice-injection part 5 of the second fluid medium supply path 4 against the LBKP slurry and allowed to pass across the LBKP slurry.

TABLE 2

| | concentration (%) | freeness (ml) *1 | transmittance (%) *2 | polymerization degree average | polymerization degree variation coefficient |
|---|---|---|---|---|---|
| untreated (Comp. Ex. 1) | 1.02 | 198 (15 min) | 67.35/74.01 | 823.2 | 1.17 |
| post-fragmentation (Ex. 2) | 1.078 | 198 (26 min) | 72.58/75.70 | 857.6 | 1.84 |

*1: The freeness is shown as an amount of filtrate water from a 0.1% CeNF slurry, and a time period until the completion of draining is shown in ( ).
*2: The transmittance (%) is a transmittance of a 0.1% CeNF slurry determined with respect to wavelengths of 400 nm and 600 nm.
*3: The height of sediment is a height of a fiber sediment measured with respect to 0.1%/0.02% CeNF slurries.

As seen in Table 2, by the fragmentation, the freeness time in which water was allowed to drain from the 200 ml of the CNF aqueous suspension was prolonged from 15 minutes in the case of the untreated sample (Comparative Example 1) to 26 minutes in the case of the post-fragmentation sample (Example 2). This shows that the starting material was pulverized by the fragmentation.

Example 3

The nano-fragmented pulp slurry obtained in Example 2 was injected from the orifice-injection opening 15 of the orifice-injection part 5 in the second fluid medium supply path 4 and thereby circulated through the second fluid medium supply path 4. The injection was effected under pressure of 200 MPa.

The nano-fragmented pulp slurry was collected every pass by the circulation. With respect to each nano-fragmented pulp slurry thus obtained by the collection, there were measured concentration, freeness, transmittance (%), polymerization degree, and height of sediment.

Comparative Example 2

Figure 7:
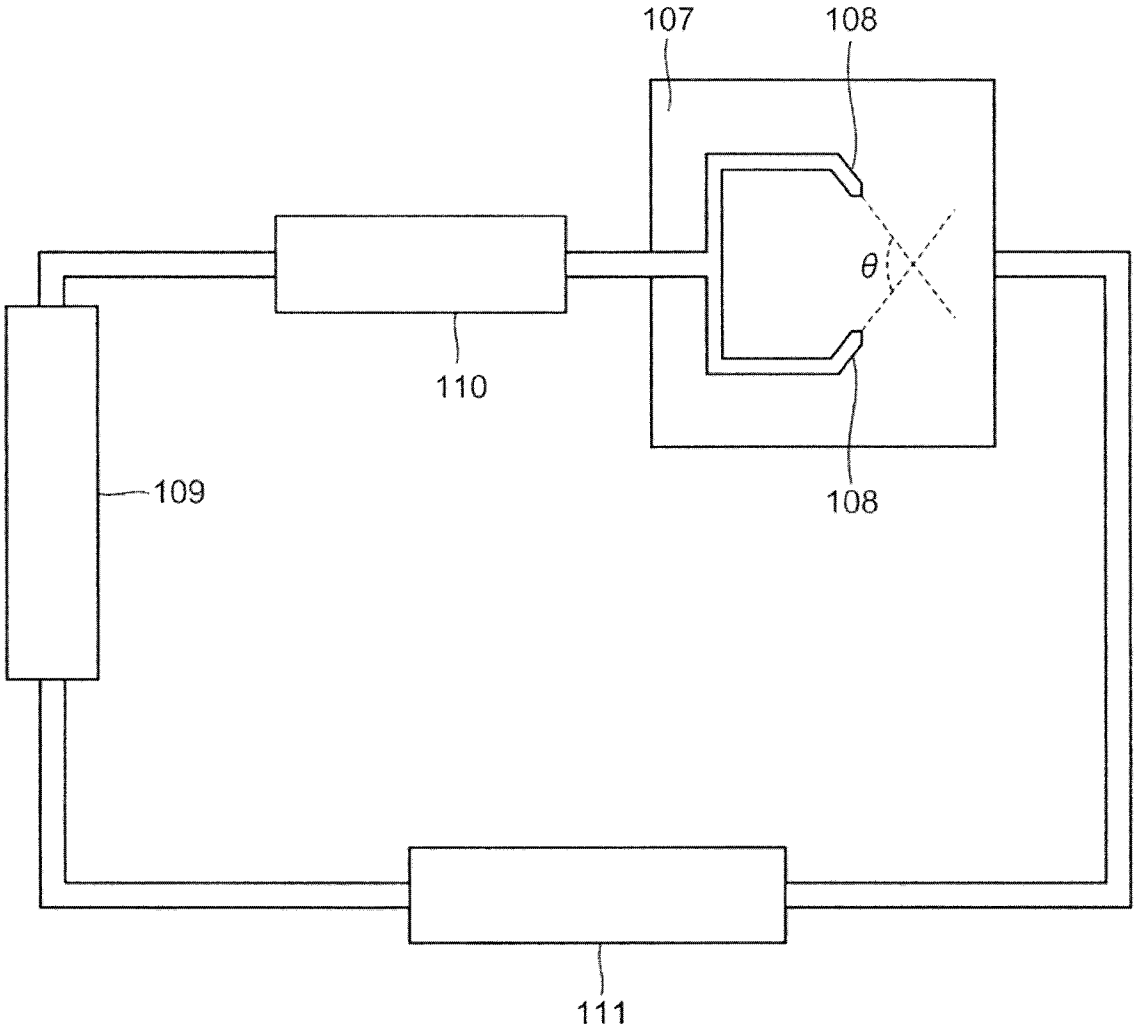
PRIOR ART FIG. 7
FIG. 7 is another diagram for illustrating another conventional method.

For comparison with each of Examples, using equipment shown in FIG. 7, a slurry of bleached hardwood kraft pulp (LBKP) was injected from opposing two nozzles (108*a*, 108*b*) under pressure of 200 MPa to perform an aqueous counter collision method. With respect to the nano-fragmented pulp slurry obtained by the aqueous counter collision method, there were concentration, freeness, transmittance (%), polymerization degree, height of sediment in substantially the same manner as in Example 3.

Figure 4:
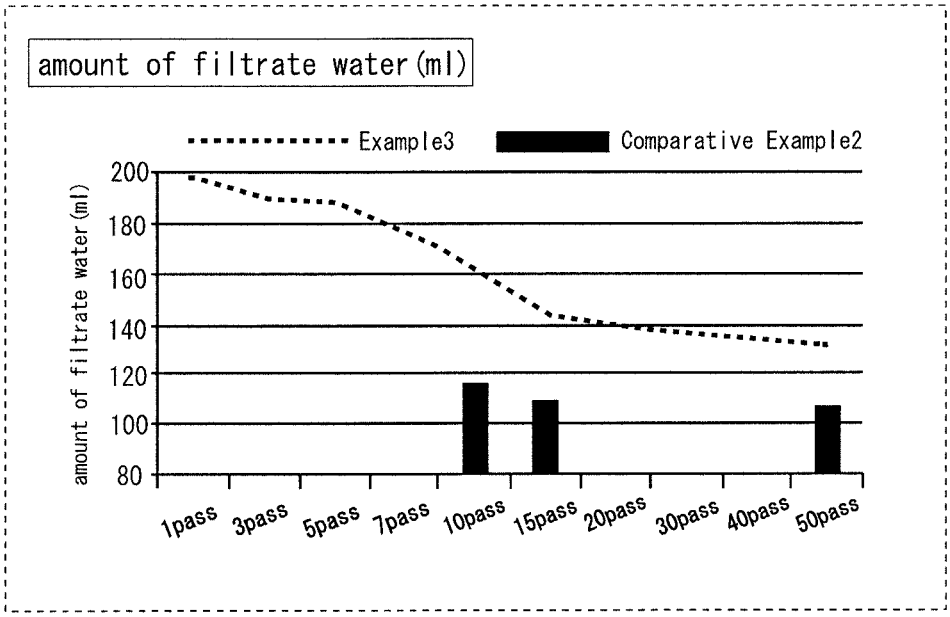
FIG. 4 is a graphical representation showing, in a comparative manner, measurement results of amounts of filtered water with respect to slurries obtained in Example 3 of the present invention and Comparative Example 2.
Figure 5:
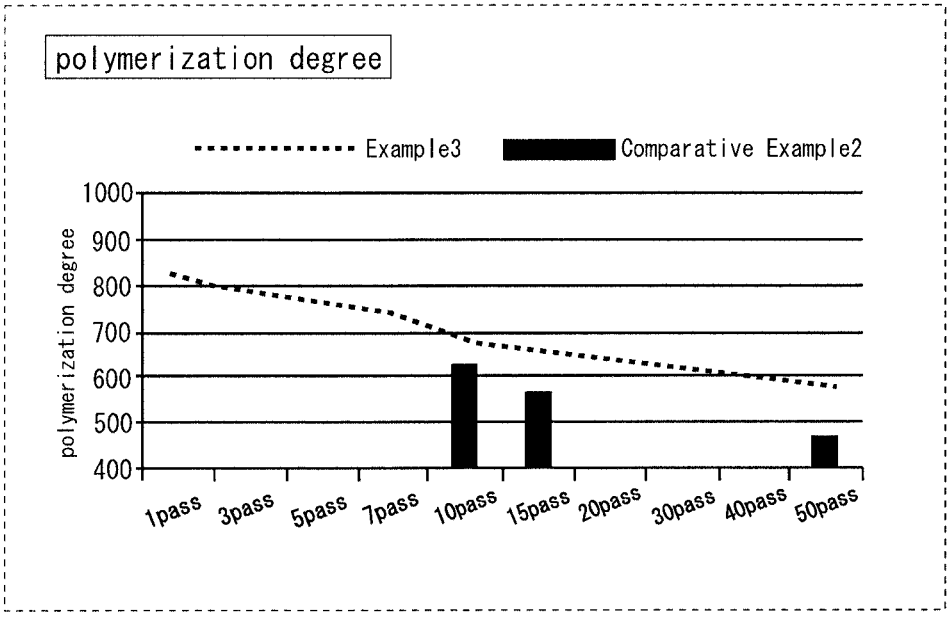
FIG. 5. is a graphical representation showing, in a comparative manner, measurement results of polymerization degrees of nano-fragmented products obtained in Example 3 of the present invention and Comparative Example 2.
Figure 6:
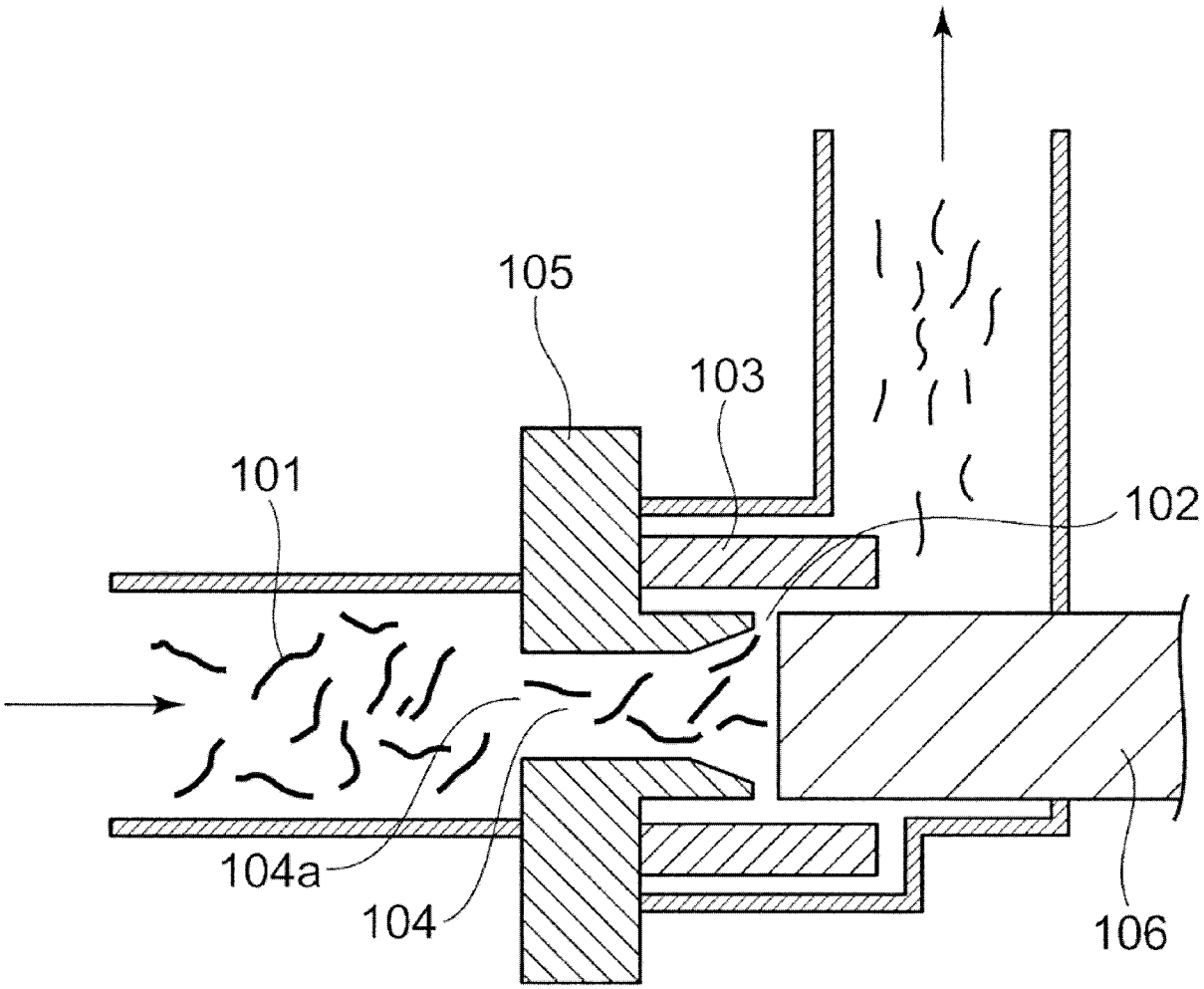
PRIOR ART FIG. 6
FIG. 6 is a diagram for illustrating a conventional method.

Results of the measurements in Example 3 and Comparative Example 2 are shown in FIG. 4 and FIG. 5 in a comparative manner.

<Freeness>

With respect to freeness, in comparison between those of the nano-fragmented pulp slurries in Example 3 and Comparative Example 2, the amount of filtrate water of the nano-fragmented pulp slurry in Example 3 is larger than that of the nano-fragmented pulp slurry in Comparative Example 2 in any number of treatments (passes). This shows that the pulp has not been fragmented unnecessarily.

It is understood that the draining time (concentration time) can be reduced in the nano-fragmented pulp slurry obtained in Example 3.

<Polymerization Degree>

The CNFs obtained in Example 3 retain polymerization degrees higher than those of the CNFs obtained in Comparative Example 2.

<Fiber Sediment>

The sedimentation state of the nano-fragmented pulp slurry in Example 3 was clearly different from that of the 0.1% suspension in Comparative Example 2. In the case of Comparative Example 2, the height of the fiber sediment in the 0.1% suspension gradually decreases to 0. In contrast to this, the nano-fragmented fibers in the nano-fragmented pulp slurry of Example 3 were in swollen state while adsorptively retaining water and dispersed, and accordingly, the height of fiber sediment increased and the border between the fiber sediment and water became difficult to recognize. From the fact that the number of treatments (passes) at which the border between the fiber sediment and water became unrecognizable is smaller in Example 3, it is understood that the fibers were uniformly fragmented at the smaller number of treatments (passes) in Example 3 as compared with the Comparative Example 2.

NOTE ON REFERENCE NUMBERS

2 . . . chamber
4 . . . fluid medium supply path
8, 11 . . . pump
7, 10 . . . tank
12 . . . heat exchanger
13 . . . plunger
9 . . . circulation path
3 . . . polysaccharide supply path
15 . . . orifice-injection opening
27*a*, 27*b* . . . through hole

The invention claimed is:

1. A device for preparing a nano-fragmented product, the device comprising:

a first fluid medium supply path; and a second fluid medium supply path, wherein the first fluid medium supply path is provided with a polysaccharide slurry supply section for supplying a polysaccharide slurry to the first medium supply path, wherein the second fluid medium supply path is provided therein with an orifice-injection part for orifice-injecting water, wherein the first fluid medium supply path is disposed so as to pass through a chamber, wherein an orifice injection opening of the orifice-injection part is set to open in the chamber so as to permit the water to pass across the first fluid medium supply path in a direction intersecting the first fluid medium supply path, wherein an outlet of the chamber is provided at a position opposite to the orifice injection opening in the chamber, wherein the second fluid medium supply path is connected to the outlet of the chamber to constitute the second fluid medium supply path, wherein in use the orifice-injection part orifice-injects a water jet such that the water jet passes across the first fluid medium supply path, thereby forming a nano-fragmented product in the water that was orifice-injected from the orifice-injection part, and wherein the polysaccharide slurry that has not been nanofragmented exits the chamber through the first fluid medium supply path.

2. The device for preparing a nano-fragmented product according to claim 1, wherein said first fluid medium supply path or said second fluid medium supply path is a circulation path.

3. The device for preparing a nano-fragmented product according to claim 1, wherein the device further comprises a plunger for supplying the water to said orifice-injection part, and wherein said plunger comprises an actuating part located at the middle thereof, and pistons for intake-discharge of the water are disposed on either side of the actuating part to enable concurrent intake and discharge of the water.

4. A method for preparing a nano-fragmented product using the device for preparing a nano-fragmented product according to claim 1, the method comprising steps of:

supplying the polysaccharide slurry to the first fluid medium supply path to cause the polysaccharide slurry to flow through the first fluid medium supply path; and orifice-injecting water in the second fluid medium supply path;

wherein the water is so orifice-injected in the second fluid medium supply path as to pass across the polysaccharide slurry flowing through the first fluid medium supply path to form the nanofragmented product in the second fluid medium supply path.

5. The method for preparing a nano-fragmented product according to claim 4, wherein said polysaccharide is pulp as a fibrous polysaccharide.

6. The method for preparing a nano-fragmented product according to claim 5, wherein said pulp is chemical pulp, mechanical pulp or used paper which are derived from a woody plant including a hardwood or a softwood, or a herbaceous plant including bamboo or reed.

* * * * *